US007681642B2

(12) United States Patent
Bell et al.

(10) Patent No.: US 7,681,642 B2
(45) Date of Patent: Mar. 23, 2010

(54) METHOD FOR LOGGING AFTER DRILLING

(75) Inventors: John W. Bell, Plano, TX (US); Larry E. Whitney, Bedford, TX (US); Keith Fitzgerald, Keller, TX (US); Thomas M. Redlinger, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 350 days.

(21) Appl. No.: 11/842,856

(22) Filed: Aug. 21, 2007

(65) Prior Publication Data

US 2008/0041587 A1 Feb. 21, 2008

Related U.S. Application Data

(60) Provisional application No. 60/823,028, filed on Aug. 21, 2006.

(51) Int. Cl.
*E21B 47/00* (2006.01)

(52) U.S. Cl. ..... 166/254.2; 175/40; 175/320; 166/242.6

(58) Field of Classification Search ..... 166/254.2, 166/242.6–242.8; 175/40, 320, 321
See application file for complete search history.

(56) References Cited

U.S. PATENT DOCUMENTS 2,719,362 A * 10/1955 Montgomery et al. ..... 33/544.3
2,719,363 A 10/1955 Montgomery et al.
2,726,848 A 12/1955 Montgomery et al.
2,868,506 A * 1/1959 Nestle ..... 250/254
4,349,072 A * 9/1982 Escaron et al. ..... 166/254.2
4,901,804 A * 2/1990 Thometz et al. ..... 175/40
5,589,825 A * 12/1996 Pomerleau ..... 340/854.9
6,269,891 B1 * 8/2001 Runia ..... 175/40
6,419,013 B1 * 7/2002 Milne et al. ..... 166/254.2
6,712,146 B2 * 3/2004 Estep et al. ..... 166/377
7,100,696 B2 * 9/2006 Marshall ..... 166/377
7,134,493 B2 * 11/2006 Runia ..... 166/254.2
7,188,672 B2 * 3/2007 Berkheimer et al. ..... 166/254.2
7,296,637 B2 * 11/2007 Gudac ..... 175/40
2005/0029017 A1 * 2/2005 Berkheimer et al. ..... 175/320

FOREIGN PATENT DOCUMENTS

WO WO 00/17488 3/2000
WO WO 03/004825 1/2003

OTHER PUBLICATIONS

PCT Search Report, International Application No. PCT/US2007/076445, dated Dec. 3, 2007.

* cited by examiner

*Primary Examiner*—Jennifer H Gay
*Assistant Examiner*—Blake Michener
(74) *Attorney, Agent, or Firm*—Patterson & Sheridan, L.L.P.

(57) ABSTRACT

A method for logging a downhole formation in a wellbore. The method comprises drilling a wellbore with a drill bit coupled to a disconnect device. The disconnect device is then actuated to detach the drill bit from a portion of a conveyance. A logging operation is then performed between two portions of the disconnect device. The disconnect device may then be reattached.

19 Claims, 8 Drawing Sheets

METHOD FOR LOGGING AFTER DRILLING

CROSS-REFERENCE TO RELATED APPLICATIONS

This application claims benefit of U.S. provisional application Ser. No. 60/823,028, filed Aug. 21, 2006, which is herein incorporated by reference in its entirety.

BACKGROUND OF THE INVENTION

1. Field of the Invention

Embodiments described herein generally relate to a method of logging a formation after drilling. More particularly, the embodiments relate to a method for selectively actuating a disconnect device and performing a logging operation between portions of the disconnect device.

2. Description of the Related Art

In the drilling, completion, and operation of a wellbore such as a hydrocarbon well, a salt water disposal, or an observation well, various wellbore components are inserted and removed from a wellbore on a lower end of a conveyance. During the completion of a hydrocarbon well it may be necessary to perform a logging operation on the wellbore. The logging operation allows the operator to gain information regarding formations adjacent the wellbore.

The logging operation must be done in an area of the wellbore that is free from any tubular such as casing in order to operate properly. Typically, to perform a logging operation, a wellbore is drilled from the surface. The drill string and drill bit are then removed from the wellbore. A wireline lowers a logging tool into the wellbore. There is the potential for the logging tool to get stuck during run-in or pull-out due to deviations in the wellbore. The wireline supplies the logging tool with a power supply and a means for data conveyance. A logging operation is performed on at least a portion of the wellbore. The wireline then removes the logging tool. A casing is then run into the wellbore and the well is completed.

The time taken to log the uncased wellbore prior to running the casing may cause problems in the completions process. The uncased wellbore may be susceptible to cave in and/or shifting. The cave-in then requires a remediation operation in order to fix the wellbore before the casing is run. Usually this involves making an extra trip in and out of the wellbore with a drill bit, which may be time consuming and therefore costly. The time required to pullout the drill string and run in the logging tool cost the valuable rig time, thereby increasing the overall cost of the completions operation.

Therefore, there is a need for a method for performing a wireline logging operation in a wellbore while the drill string is still in place.

SUMMARY OF THE INVENTION

The embodiments described herein generally relate to a method of performing a logging operation in a wellbore. The method comprises drilling a wellbore with a drill assembly comprising a drill bit coupled to a conveyance. The method further comprises disconnecting a disconnect device coupled to the conveyance and thereby uncoupling the drill bit from at least a portion of the conveyance. The method further comprises performing a logging operation between two portions of the disconnect device. The method further comprises reattaching the disconnect device and continuing the drilling of the wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of methods for disconnecting from a Bottom Hole Assembly (BHA) and performing a logging operation in a wellbore are provided. A work string is provided with a bottom hole assembly (BHA), a logging tool and a disconnect device. The BHA includes a drill bit for forming the wellbore. The work string is run into the wellbore on a conveyance. The BHA is operated until the operation is complete. The disconnect device may then be actuated to release a bottom sub of the disconnect device from a release sub. The bottom sub remains coupled to the BHA while the release sub remains coupled to the conveyance. The logging tool may then be used to perform a logging operation in the wellbore. The release sub may then be reattached to the bottom sub, and the wellbore may be completed.

Figure 1:
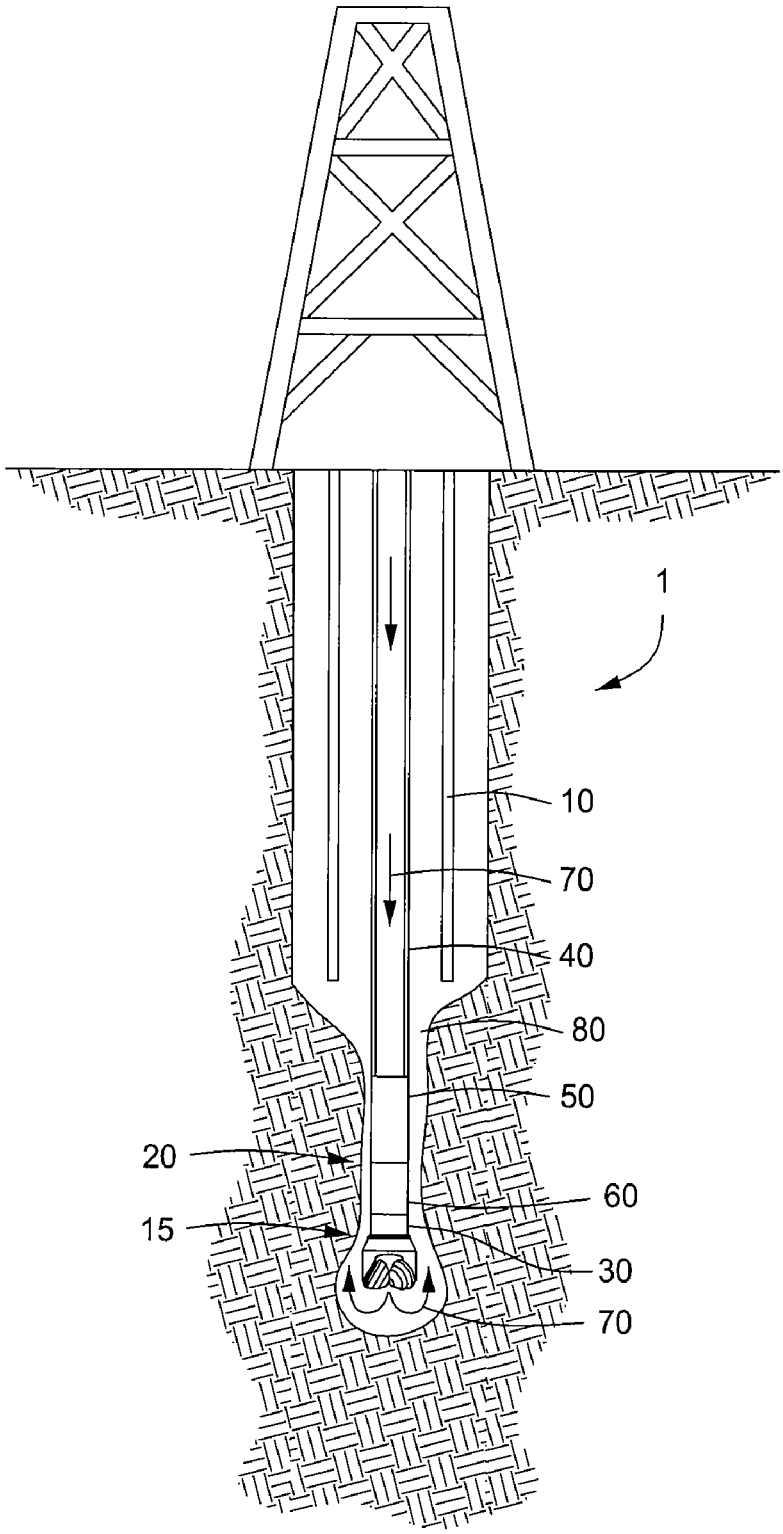
FIG. 1 is a schematic view of a wellbore and a disconnect device according to one embodiment described herein.

FIG. 1 is a schematic view of a wellbore 1 having a casing 10 and a work string 15 which includes a disconnect device 20, a BHA 30, and a conveyance 40. As shown, the conveyance 40 is a drill string which may be rotated and axially translated from the drill rig; however, it should be appreciated that the conveyance 40 could be any suitable conveyance for use in a wellbore such as a coiled tubing, or casing. The BHA 30 includes a drill bit configured to form a wellbore. The disconnect device 20 contains a release sub 50 and bottom sub 60. A flow path 70 may be provided through the conveyance 40, the release sub 50, the bottom sub 60, and/or the BHA 30. Fluid may flow from the flow path 70 into an annulus 80 as will be described in more detail below.

Figure 2:
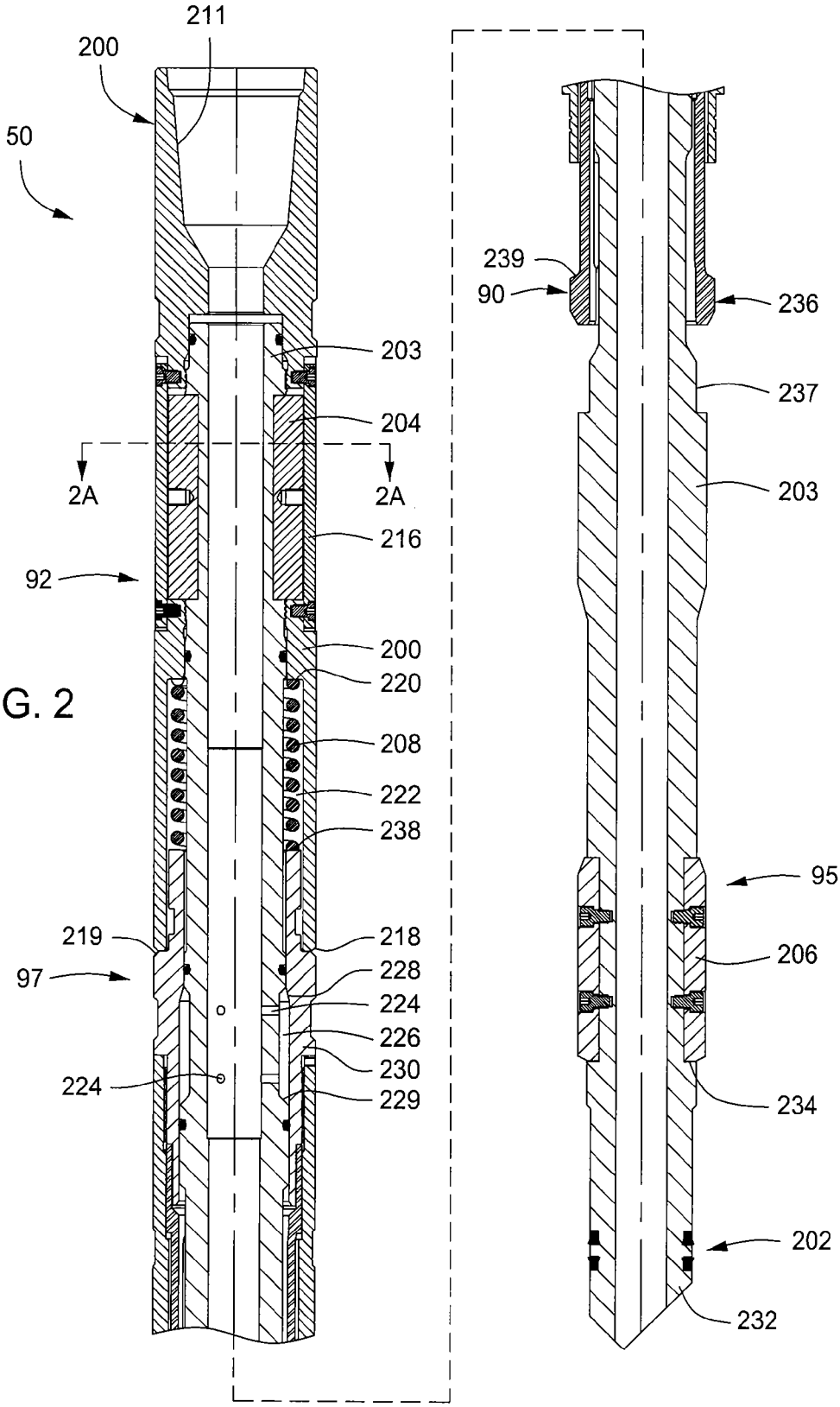
FIG. 2 is a cross sectional view of a release sub according to one embodiment described herein.

FIG. 2 is a cross sectional view of the release sub 50 according to one embodiment. The release sub 50 is fluid actuated, as will be described in more detail below. The release sub 50 comprises the body 92, the connector end 200, the locking member 90, the torsion transfer member 95, the actuator 97, and the stabbing end 202. The body 92 may include a mandrel 203, a connector member 204, and an alignment member 206.

Figure 2A:
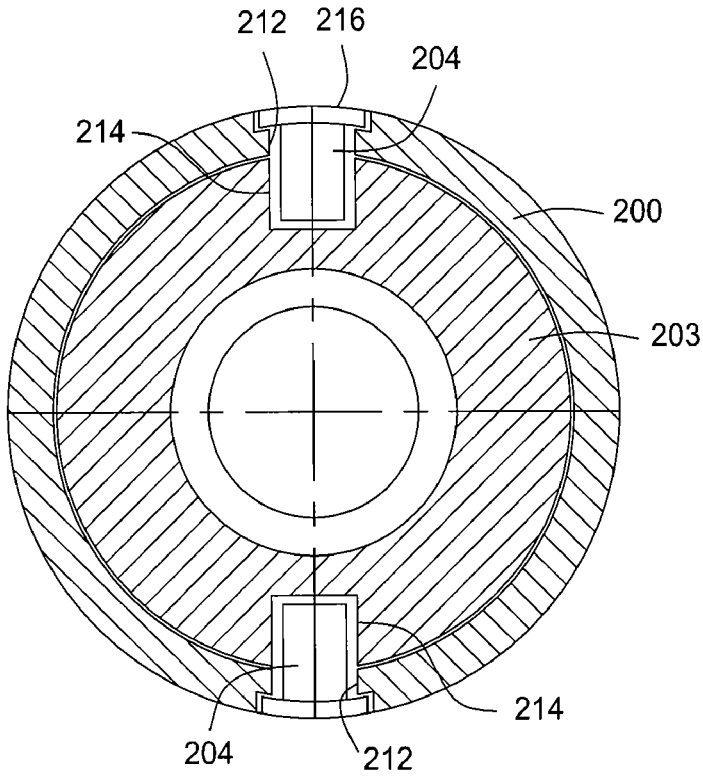
FIG. 2A is a cross sectional end view of the release sub according to one embodiment described herein.

The connector end 200 may have a box end 211 adapted to couple to a downhole end of the conveyance 40. The connector end 200 couples the conveyance 40 to the mandrel 203. As shown, the connector end 200 couples to the mandrel 203 via the connector member 204. The connector end 200 and the mandrel 203 are shown having two slots 212 and 214, shown in FIG. 2A, for receiving the connector member 204; however, it is contemplated that any number of slots 212 may be used. The connector member 204 is located in the slots 212 and 214. A cover 216 couples to the connector end 200 and holds the connector member 204 in place. Once in place, the connector member 204 prevents relative movement between the connector end 200 and the mandrel 203 by the connector end engaging the slots 212 and 214. Although, the mandrel 203 is shown as coupled to the connector end 200 through the connector members 204, it should be appreciated that the mandrel 203 and connector end 200 may be coupled in any suitable manner or may be one unit. The lower end of the connector end 200 has a nose 218 configured to engage and house portions of actuator 97 as will be described in more detail below.

The lower end of the connector end 200 forms a nose 218. The nose 218 may limit the movement the actuator 97 as will be described below. The connector end 200 may further comprise of a shoulder 220. The mandrel 203 and the connector end 200 form a chamber 222 there between for housing a biasing member 208. The shoulder 220 may form an upper end of the chamber 222. The chamber 222 may further house an end of a piston 230 which is adapted to be acted upon by the biasing member 208.

The mandrel 203 supports the actuator 97, the locking member 90, the torsion transfer member 95, and forms the stabbing end 202. The mandrel 203 may contain ports 224 adapted to supply a fluid to a piston chamber 226 in order to apply pressure to a piston surface 228 of a piston 230 and an opposing piston surface 229 of the mandrel 203, as will be described in more detail below. The lower end of the mandrel 203 has a nose 232 and slots 234 for securing the torsion transfer member 95. The nose 232 and torsion transfer member 95 are adapted to self-align the release sub 50 with the bottom sub 60. The torsion transfer member 95 additionally provides a torque transfer function to transfer torque from the release sub 50 to the bottom sub 60. The mandrel 203 may further comprise a locking profile 237. The locking profile 237 restricts the movement of the locking member 90 when the locking member is in the locked position.

The actuator 97 may comprise a piston and chamber 210 and a biasing member 208. The piston and chamber 210 includes the piston 230 and the piston chamber 226. The piston 230 travels relative to the mandrel 203 and thereby actuates the locking member 90. A portion of the piston 230 is located in the chamber 222 and has an upper end 238 which is operatively coupled to the biasing member 208. The piston 230 may include an upset 219 adapted to engage the nose 218, thereby providing a travel stop for the piston 230 toward an unlocked position. The piston 230 and piston chamber 226 may comprise two piston surfaces, an upper piston surface 228, and a lower piston surface 229. The piston surfaces 228 and 229 influenced by fluid pressure supplied through the ports 224 in the mandrel 203 manipulate the piston 230. Fluid pressure applied to the upper piston surface 228 motivates the piston 230 and thereby the locking member toward an unlocked position. The piston surfaces 228 and 229 are shown at an angle, but it is contemplated that any angle may be used including perpendicular to the piston actuation direction.

Figure 3:
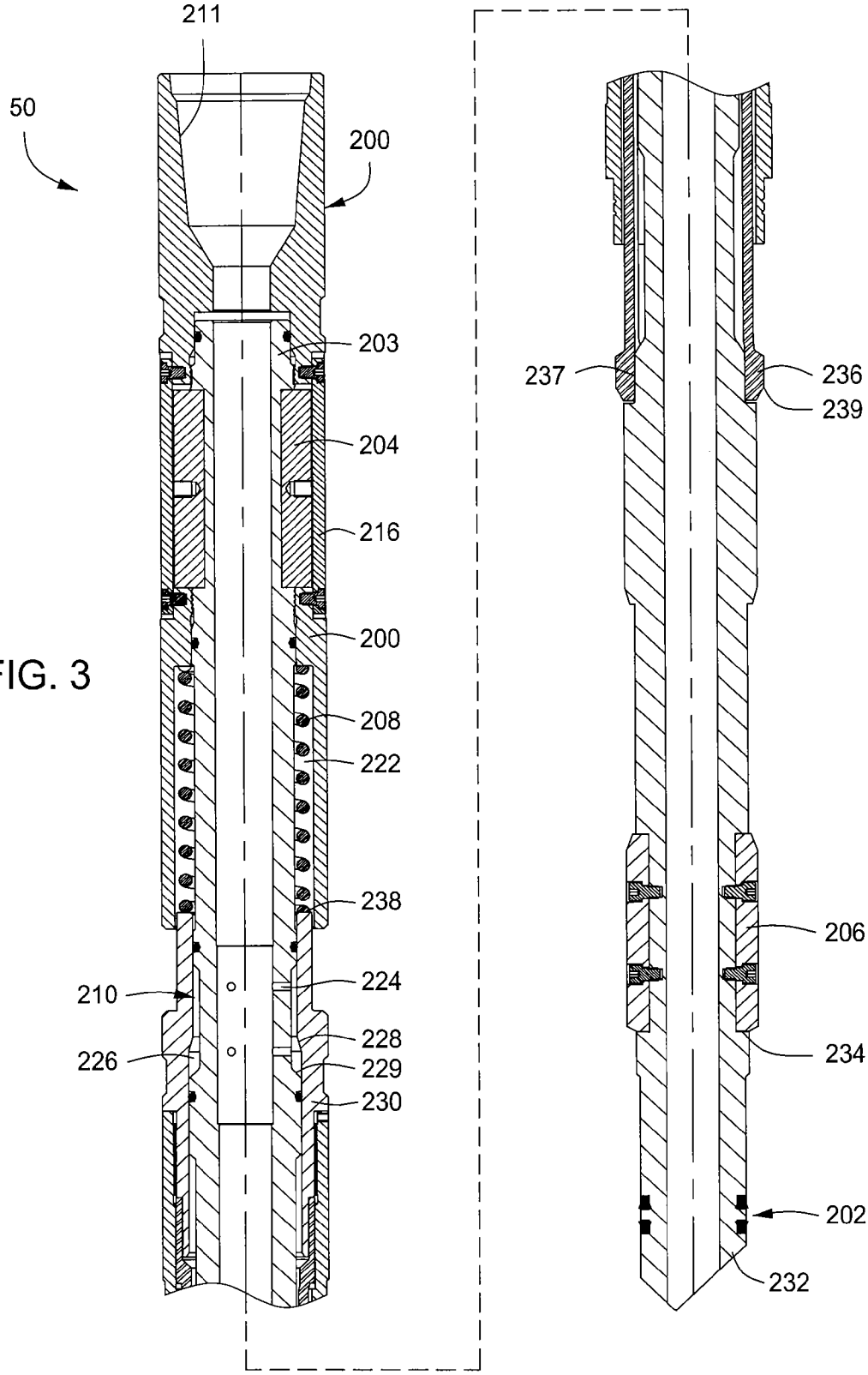
FIG. 3 is a cross sectional view of a release sub according to one embodiment described herein.

The biasing member 208 biases the piston 230 and thereby the locking member 90 toward the locked position. As shown, the piston 230 has an upper end 238 which is motivated by the biasing member 208 for biasing the piston 230 toward the locked position, as shown in FIG. 3. The biasing member 208 is shown as a coiled spring; however, it is contemplated that the biasing member may be any suitable biasing member such as a hydraulic or pneumatic biasing member, an elastic member, etc.

The locking member 90 as shown is the collet 236. The piston 230 is coupled to the collet 236. The collet 236 moves axially relative to the mandrel 203 between the release position shown in FIG. 4 and the locked position shown in FIG. 5. The collet 236 has an upset profile 239 adapted to engage the locking profile 99 of the bottom sub 60. In the locked position, an interior side of the collet 236 engages the locking profile 237 of the mandrel 203. In this position, the locking profile 237 prevents the collet 236 from moving radially inward. Thus, in the locked position the upset profile 239 of the collet 236 is engaged with the locking profile 99. In the release position, the piston 230 has moved radially up relative to the mandrel 203. The interior side of the collet 236 moves above the locking profile 99 thereby allowing the collet 236 to move radially inward. The radially movement of the collet 236 allows the collet 236 to be removed from the locking profile 99.

In one embodiment, the torsion transfer member 95 comprises one or more alignment members 206. The alignment members 206, as shown, are members coupled to the mandrel 203. The alignment members 206 extend beyond the outer diameter of the mandrel 203 and are adapted to engage a matching slot or profile in the bottom sub 60. The alignment members 206 provide a torque transfer function to transfer torque from the release sub 50 to the bottom sub 60. Additionally, the alignment members 206 may be adapted to guide the release sub 50 into proper alignment with the bottom sub 60. Although the alignment members 206 are described as being a separate member coupled to the mandrel 203, it should be appreciated that the alignment members 206 may be integral with the mandrel 203. Further, the alignment members may be coupled to the bottom sub 206 and configured to engage a slot on the mandrel 203. The alignment members 206 may take any suitable form so long as the alignment members 206 are capable of transferring torque from the release sub 50 to the bottom sub 60.

Figure 4A:
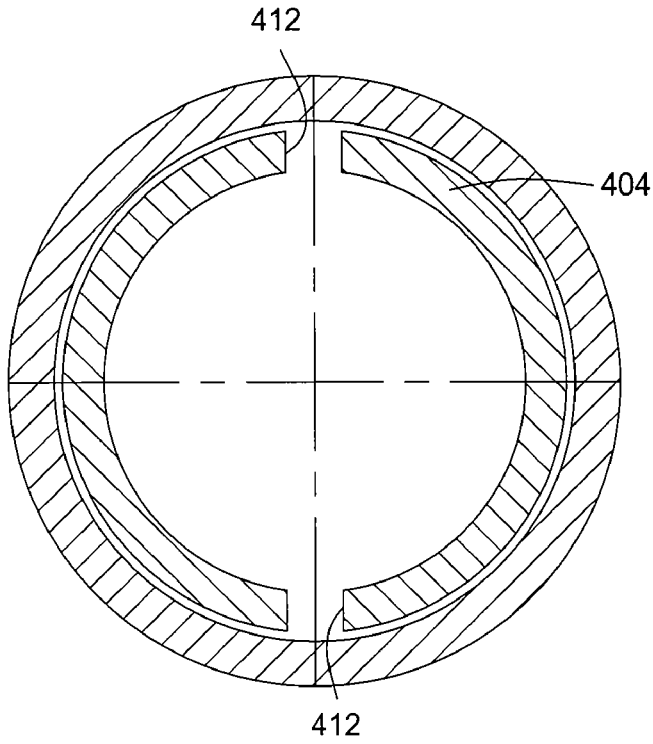
FIG. 4A is a cross sectional end view of the bottom sub according to one embodiment described herein.
Figure 4:
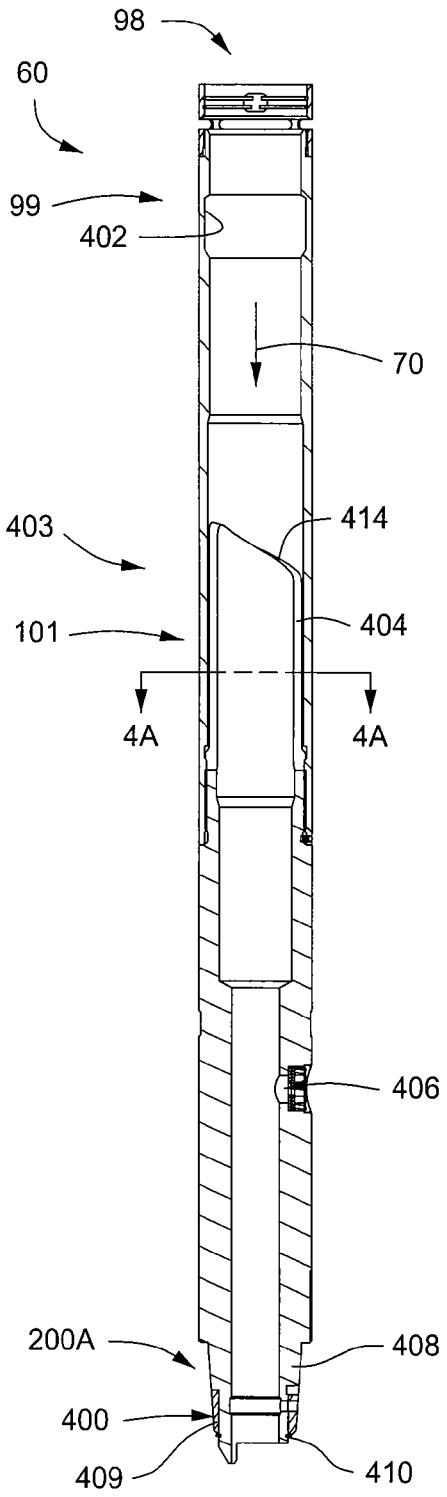
FIG. 4 is a cross sectional view of a bottom sub according to one embodiment described herein.

A cross sectional view of the bottom sub 60 is shown in FIG. 4. The bottom sub 60 includes the receiving end 98, the locking profile 99, the torsion profile 101, the connector end 200A, and an optional circulation port 406. As discussed above the bottom sub 60 is configured to selectively receive and engage the release sub 50. The receiving end 98, as shown, is simply an opening in the bottom sub 60 configured to receive the stabbing end 202 of the release sub 50.

The locking profile 99 is a fishing profile 402 in one embodiment. The fishing profile 402 is configured to receive the upset profile 239 of the collet 236 when the collet 236 is in the locked position. The fishing profile 402 may have any suitable form so long as the fishing profile 402 receives the collet 236 and prevents the collet 236 from moving from the fishing profile 402 while the collet 236 is in the locked position. Thus, with the collet 236 in the fishing profile 402 and in the locked position the release sub 50 is axially engaged with the bottom sub 60.

The bottom sub 60 may further include an alignment portion 403 configured to guide and align the release sub 50. As shown the alignment portion 403 is a mule shoe 404. The mule shoe 404 may include an alignment nose 414. The alignment nose is configured to receive and maneuver the nose end 232 of the release sub 50 into the locked position. The mule shoe 404 may have one or more alignment slots 412 as shown in FIG. 4A. The alignment slots 412 are configured to receive the alignment members 206 of the release sub 50. Thus, the nose 232 of the release sub 50 enters into the mule shoe 404 as the release sub 50 travels into the bottom sub 60. The alignment members 206 encounter the alignment nose 414 of the mule shoe 404. The alignment nose 414 may rotate the release sub 50 until the alignment members 206 are in line with the alignment slots 412. The alignment members 206 continue to travel in the mule shoe 404 until the collet 236 is in the locked position. The alignment members 206 engage the alignment slots 412 when the release sub 50 is rotated, thereby preventing relative rotation between the release sub 50 and the bottom sub 60.

Figure 5:
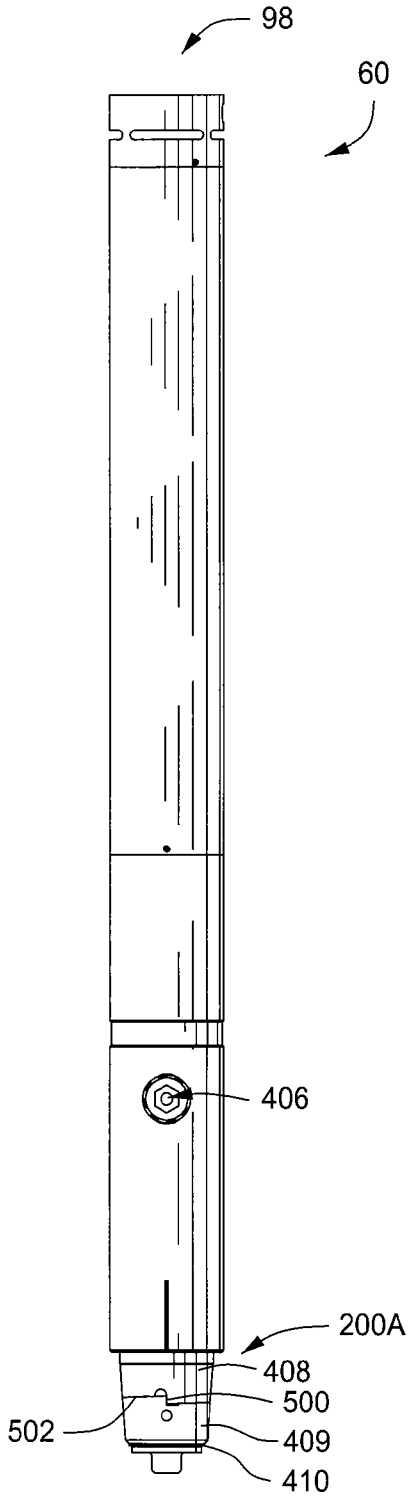
FIG. 5 is a front view of a bottom sub according to one embodiment described herein.

In one embodiment, the connector end 200A of the bottom sub 60 has a threaded pin end 400. The pin end 400 may have a locking thread system for connection with a box end of the BHA 30. The pin end 400 has an upper thread portion 408 and a lower thread portion 409. The upper thread portion 408 may be immovably coupled to the bottom sub 60. The lower thread portion 409 may be adapted to rotate about the axis of the bottom sub 60. The lower thread portion 409 may be held onto the bottom sub 60 by a retaining ring 410. Each of the upper thread portion 408 and the lower thread portion 409 have a shoulder 500, as shown in FIG. 5. The shoulders 500 of the thread portions 408 and 409 are designed to allow the thread portions 408 and 409 to move as one unit when rotated in a first direction. When rotated in a second direction the shoulders 500 move apart due to the free rotation of thread potion 409. Each of the thread portions 408 and 409 have a sloped edge 502. The engagement of the sloped edges 502 push the thread portions 408 and 409 axially away from one another as the rotation in the second direction continues. The thread portions 408 and 409 moving in opposite axial directions thereby cause the threads of the thread portions 408 and 409 to lock both portions against the corresponding threads of a box member of the BHA. Thus, the pin end 400 is adapted to screw into the BHA 30 when rotated in a first direction, but when the pin end 400 is rotated in a second direction, the locking action prevents the inadvertent unscrewing of the bottom sub 60 from the BHA 30. Thus, rotation of the bottom sub 60 in either direction will transfer torque to the BHA 30. Although the connector ends 200 and 200A are described as threaded connections, it should be appreciated that the connector ends may be any suitable connection to the conveyance 40 and the BHA 30 including, but not limited to a collar, a drill collar, a welded connection a pinned connection.

Figure 6:
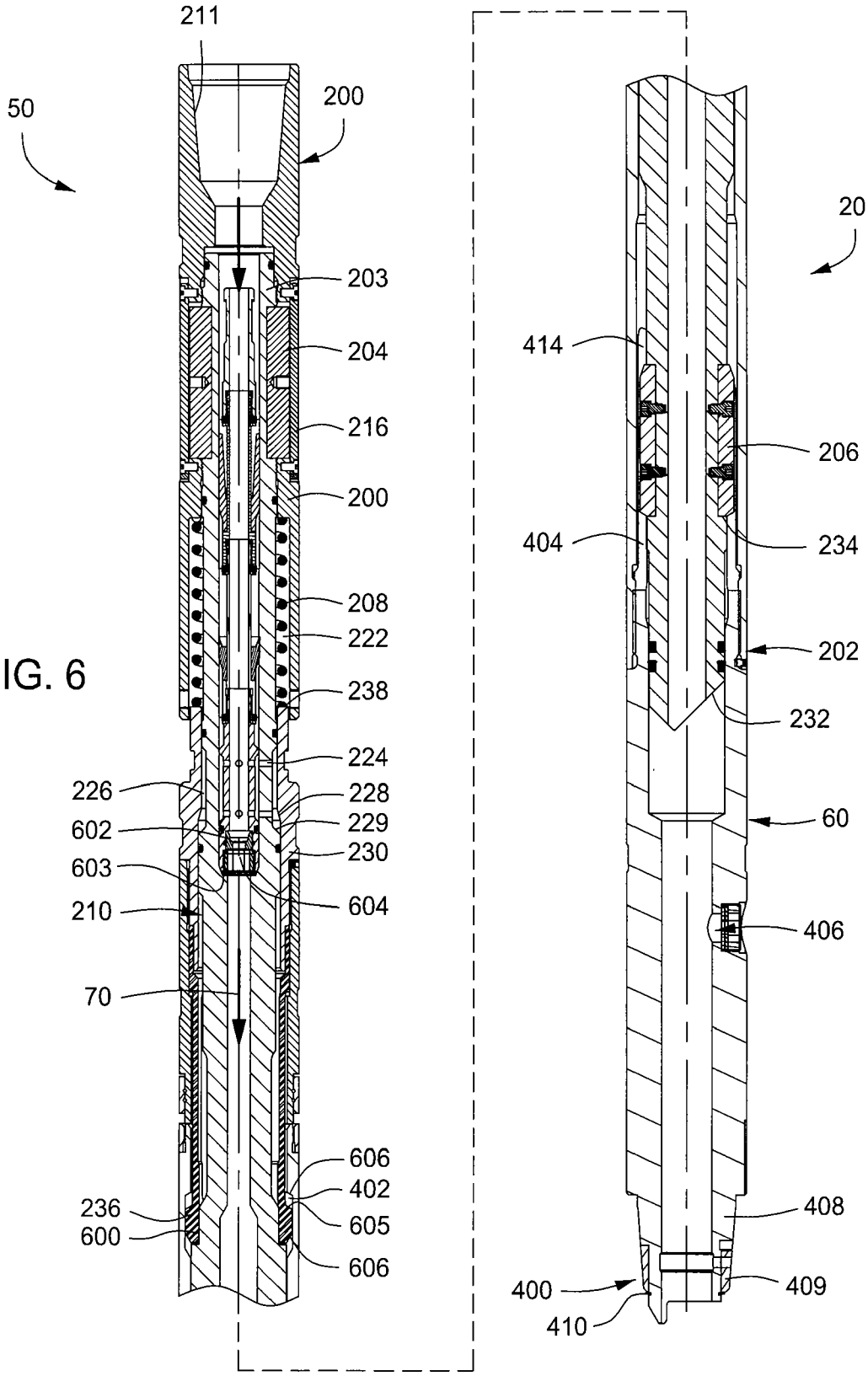
FIG. 6 is a cross sectional view of a disconnect device according to one embodiment described herein.

The disconnect device 20 is used in conjunction with a drilling operation. The release sub 50 and bottom sub 60 are coupled together at the surface as shown in FIG. 6. In the locked position, the collet 236 of the release sub 50 is located in the fishing profile 402 of the bottom sub 60. The locking profile 237 of the mandrel 203 retains the collet 236 within the fishing profile 402 and in the locked position. The biasing member 208 maintains a force on the piston 230 which maintains the collet 236 in the locked position. With the release sub 50 and the bottom sub 60 forming the disconnect device 20, the pin end 400 is coupled to the BHA 30 which is a drilling assembly and the box end 211 is coupled to the conveyance 40 as shown in FIG. 1. The work string 15 may then be rotated and lowered into the wellbore by any suitable method. The connector member's 204 transfers rotation from the conveyance 40 to the release sub 50. The alignment members 206 transfer rotation from the release sub 50 to the bottom sub 60 and in turn to the drill bit. In another embodiment, a downhole motor, not shown, may be used to rotate the disconnect device 20 or the BHA 30. The wellbore may then be formed using the workstring 15 while flowing fluids through the disconnect device 20 to lubricate the drill bit and wash cuttings up the annulus 80.

During the drilling operation or when the drilling operation is complete it may be desired to perform a logging operation. When the drilling operation is complete, the entire workstring 15 may be removed from the wellbore 1 by methods known in the art. To perform the logging operation, an operator may disconnect the release sub 50 from the bottom sub 60 and a logging operation may be performed between the two subs.

To disconnect the release sub 50, a dart 602 may be dropped down the conveyance 40 until it lands on a seat 603. The dart 602 may have a flow path restriction 604 or may fully obstruct the flow path 70. With the dart 602 on the seat 603, the fluid pressure may be increased through the ports 224 and into the piston chamber 226. The increased fluid pressure applies a force on the piston surfaces 228 and 229 which opposes the biasing force created by the biasing member 208. Although, the pressure increase is accomplished using a dart it should be appreciated that other methods for increasing the fluid pressure may be used including, but not limited to, pumping down the drill string and creating a back pressure against the BHA, or creating a back pressure against a tool such as the logging tool located in the disconnect device 20. The fluid pressure is then increased until the force on the piston surfaces 228 and 229 is greater than the force of the biasing member 208. The force on the piston surfaces 228 and 229 may also have to overcome the weight of the bottom sub 60 and any of the BHA 30 hanging from the bottom sub 60. Because the bottom sub 60 and the BHA 30 both hang from the collet 236, the weight of the bottom sub 60 and the BHA 30 may create an additional force that acts in conjunction with the biasing force to keep the disconnect device 20 in the locked position. The force created by the weight of the bottom sub 60 may be overcome by increasing the fluid pressure above the dart 602 and/or by lowering the conveyance 40 to neutralize the effect of the weight. With the force on the piston surfaces 228 and 229 greater than the biasing force and weight force, the biasing member 208 compresses due to relative movement between the piston 230 and the mandrel 203, as shown in FIG. 2. As the biasing member 208 is compressed toward the release position, there is relative movement between the mandrel 203 and the bottom sub 60, that is the mandrel 203 may move downward relative to the bottom sub 60. The collet 236 retains the bottom sub 60 until the locking profile 237 of the mandrel 203 is no longer juxtaposed against the fingers of the collet 236. With the collet 236 no longer supported by the locking profile 237, further relative axial movement between an angled collet surface 605 and an angled fishing profile surface 606 move the fingers of the collet 236 radially inward to a position where the collet 236 is free from the fishing profile 402. The release sub 50 may then be lifted above the bottom sub 60 using the conveyance 40 and a logging operation may be performed as will be described below.

To reattach the release sub 50 to the bottom sub 60, the conveyance lowers the release sub 50. The nose 232 of the release sub 50 is angled in a manner that will guide the release sub 50 into the top of the bottom sub 60 and eventually into the mule shoe 404 as the release sub 50 travels into the bottom sub 60. The alignment members 206 then encounter the alignment nose 414 of the mule shoe 404. The alignment nose 414 may rotate the release sub 50 until the alignment members 206 are in line with the alignment slots 412, shown in FIG. 6A. The release sub 50 continues to move downward with the collet 236 in the locked position until the collet 236 encounters the bottom sub 60. The bottom sub 60 will encounter the lower fishing profile surface 606. As the release sub 50 continues to be forced down, the force overcomes the biasing force and moves the mandrel 203 down, relative to the collet 236, to the release position, as shown in FIG. 2. The release sub 50 may then be lowered until the collet 236 is in the fishing profile 402. The downward force is then decreased to allow the biasing member 208 to move the mandrel 203 relative to the piston 230 to the locked position as shown in FIG. 6. The disconnect device 20 may then be used to continue drilling with the BHA. Therefore, the release sub 50 may be attached, released, and reattached any number of times as required.

Figure 7:
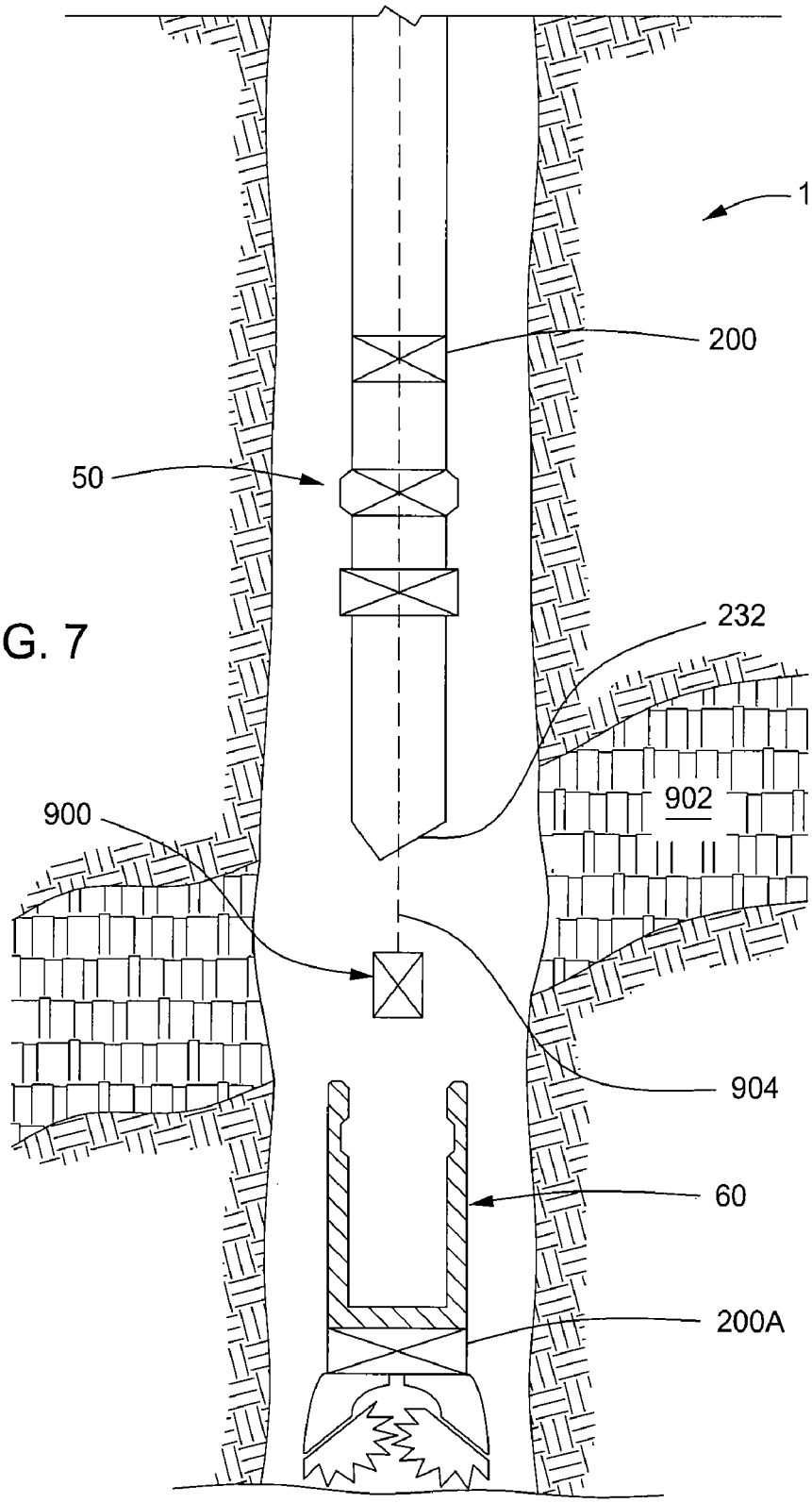
FIG. 7 is a schematic view of a wellbore and a disconnect device according to one embodiment described herein.

FIG. 7 depicts a schematic view of the disconnect device 20 in the wellbore 1 used for the logging operation. The disconnect device is run into the wellbore 1 with the BHA 30. The drill bit forms the borehole to a desired depth as described above. The disconnect device 20 is actuated in order to disconnect the release sub 50 from the bottom sub 60 as described above. The disconnect device 20 is configured to have a bore large enough for a logging tool 900 to run through at least a portion of the disconnect device 20. Thus, when the logging operation is to be performed, the logging tool 900 is run into the wellbore 1 and through the disconnected release sub 50. It may be necessary to fish out the dart before running the logging tool 900 through the disconnect device 20. Once the disconnect device 20 is at a desired location in the wellbore 1, the release sub 50 is released from the bottom sub 60. The release sub 50 may be raised relative to the bottom sub 60 in order to create a large enough space for a logging operation to be performed. The logging tool 900 is then moved to a position beyond the nose 232 of the release sub 50. The logging tool 900 begins to perform a logging operation within the wellbore to determine the location of underground formations 902. The conveyance 40 or a wireline 902 may manipulate the logging tool 900 within the wellbore 1. Once the logging operation is complete, the release sub 50 may be reattached to the bottom sub 60 in order to continue downhole operations with the drill bit. The logging tool 900 may be any suitable logging tool including, but not limited to, a nuclear logging tool, a resistivity logging tool, a sonic logging tool, an ultrasonic logging tool, a CNL-GR, or a gamma ray logging tool.

The logging tool 900, as shown, is coupled to the wire line 904. The wire line 904 allows an operator at the surface to manipulate the logging tool 900 within the wellbore 1. Thus, the operator may manipulate the logging tool 900 with the wire line 904 and/or the conveyance 40 in order to perform the logging operation. Further, the wire line 904 is capable of transmitting and receiving signals to and from the logging tool 900. Thus, the logging tool 900 may send information regarding the wellbore 1 to the surface during the logging operation. Although the logging tool 900 is shown with a wire line 904, it should be appreciated that any suitable conveyance may be used to manipulate the logging tool 900 including, but not limited to, a slick line, a cable, and a Corod.

Once the logging operation has been performed the logging tool 900 may be moved to a location within the disconnect device 20, the conveyance, or out of the wellbore. The release sub 50 may then be connected to the bottom sub 60 as described above. With the disconnect device 20 reconnected, the BHA 30 may be used to continue drilling in the wellbore if drilling operations are not complete. Once the drilling operations are complete, the disconnect device 20 and the BHA 30 may be removed from the wellbore. Casing and/or liner may then be run into the wellbore and the wellbore completed.

In an alternative embodiment, the logging tool 900 may include a memory device, a power supply and/or an optional transmitter. In this embodiment, the logging tool 900 stores data regarding the logging operation in the memory device, thus the wire line 904 is not necessary. The memory device may store the data until the logging tool 900 is removed from the wellbore 1. Further, the transmitter may be used to transmit the data from the wellbore during the logging operation. Transmittal of information may be continuous or a one time event. Suitable telemetry methods include pressure pulses, fiber-optic cable, acoustic signals, radio signals, and electromagnetic signals. Thus, the logging tool 900 may be run into the wellbore by a conveyance other than a wireline including, but not limited to, a slick line and/or may be pumped into the wellbore.

In an alternative embodiment, the logging tool 900 is run into the wellbore 1 with the disconnect device 20. In this embodiment, the logging operation may be performed once the disconnect device 20 is disconnected without the need to run the logging tool 900 into the wellbore. Thus, when the logging operation is to be performed, the disconnect device 20 is disconnected and the release sub 50 is separated from the bottom sub 60. The logging tool 900 which is already proximate or within the release sub 50 may be manipulated as described above in order to provide information about the downhole formations 902.

Figure 8:
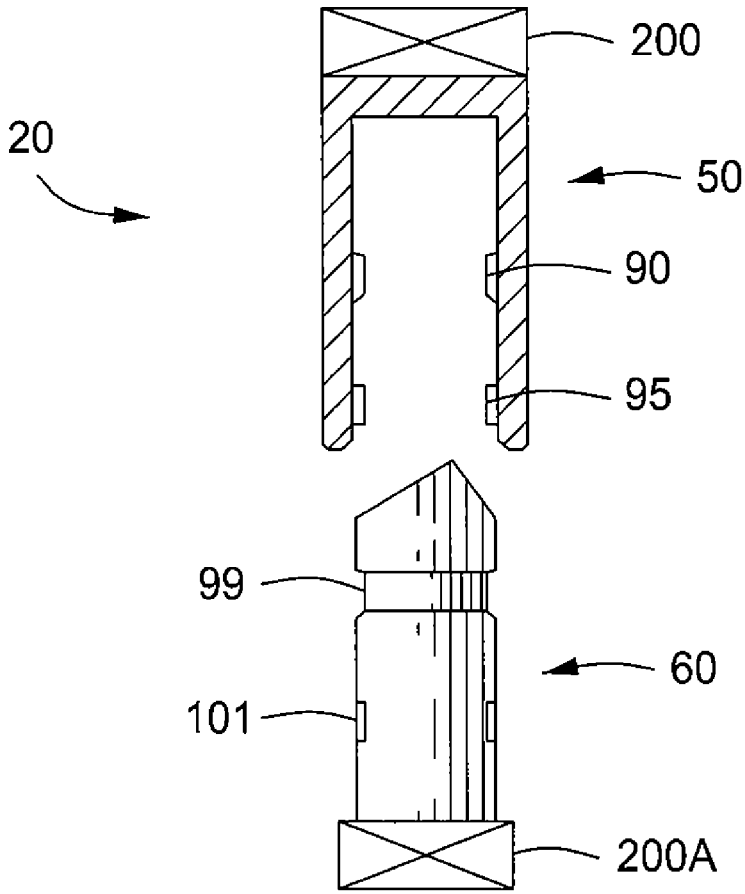
FIG. 8 a schematic view of a disconnect device according to one embodiment described herein.

FIG. 8 is a schematic view of a disconnect device 20 according to an alternative embodiment. In this embodiment, the release sub 50 is an overshot tool instead of a spear. The bottom sub 60 is a spear adapted to be engaged by the release sub 50. The release sub 50 may include the locking member 90, the torsion transfer member 95, the actuator 97, and the connector end 200, as described herein. The bottom sub 60 may include the locking profile 99 and the torsion profile 101 and the connector end 200A as described herein.

While the foregoing is directed to embodiments of the present invention, other and further embodiments of the invention may be devised without departing from the basic scope thereof, and the scope thereof is determined by the claims that follow.

The invention claimed is:

1. A method for performing a logging operation in a wellbore, comprising:
   - providing a disconnect device having a bottom sub, and a release sub;
   - coupling the disconnect device to a drilling assembly and a conveyance;
   - forming a wellbore with the drilling assembly;
   - disconnecting the release sub from the bottom sub using a hydraulic actuator;
   - raising the release sub relative to the bottom sub;
   - thereafter running a logging tool through the release sub;
   - logging a portion of the wellbore between release sub and the bottom sub; and
   - reattaching the release sub to the bottom sub.

2. The method of claim 1, further comprising pulling the logging tool out of the disconnect device after obtaining information about a downhole formation.

3. The method of claim 1, further comprising transferring torque from the conveyance through the disconnect device to the drilling assembly.

4. The method of claim 1, further comprising drilling further with the drilling assembly to locate the disconnect device proximate a second downhole formation.

5. The method of claim 4, further comprising:

disconnecting the release sub from the bottom sub proximate the second downhole formation;

manipulating the logging tool;

obtaining information about the second downhole formation; and reattaching the release sub to the bottom sub.

6. The method of claim 1, further comprising removing the drilling assembly from the wellbore.

7. The method of claim 6, further comprising running a casing into the wellbore.

8. The method of claim 1, further comprises obstructing a flow path through the disconnect device to use the hydraulic actuator.

9. The method of claim 8, further comprises removing the obstruction from the flow path prior to running the logging tool.

10. A method for performing a logging operation in a wellbore, comprising:

drilling the wellbore with a drilling assembly coupled to a disconnect device wherein the disconnect device is coupled to a conveyance;

actuating a hydraulic actuator to operate the disconnect device;

disconnecting the disconnect device and thereby uncoupling the drilling assembly from at least a portion of the conveyance;

thereafter running a logging tool through the conveyance to perform a logging operation between two portions of the disconnect device; and reattaching the disconnect device.

11. The method of claim 10, wherein performing a logging operation further comprises obtaining information about a downhole formation with the logging tool.

12. The method of claim 11, further comprising running the logging tool through one portion of the disconnect device on a wireline.

13. The method of claim 11, further comprising pumping the logging tool into the wellbore.

14. The method of claim 10, further comprising removing the drilling assembly from the wellbore.

15. The method of claim 14, further comprising running a casing into the wellbore.

16. The method of claim 10, further comprising running the logging tool into the wellbore with the disconnect device.

17. The method of claim 10, further comprising providing the disconnect device having a bottom sub and a release sub.

18. The method of claim 10, further comprising transferring torque through the disconnect device during drilling.

19. The method of claim 10, wherein the conveyance is a casing.

* * * * *

UNITED STATES PATENT AND TRADEMARK OFFICE

CERTIFICATE OF CORRECTION

PATENT NO. : 7,681,642 B2
APPLICATION NO. : 11/842856
DATED : March 23, 2010
INVENTOR(S) : John W. Bell et al.

It is certified that error appears in the above-identified patent and that said Letters Patent is hereby corrected as shown below:

In the Claims:

Column 8, Claim 1, Line 56, before "release", please add --the--.

Column 9, Claim 8, Line 12, please delete "comprises" and insert --comprising--.

Column 9, Claim 9, Line 15, please delete "comprises" and insert --comprising--.

Column 10, Claim 11, Line 5, after "performing", please delete "a" and insert --the--.

Signed and Sealed this
Fifteenth Day of May, 2012

David J. Kappos

David J. Kappos
*Director of the United States Patent and Trademark Office*